US005376426A

United States Patent [19]

Harpell et al.

[11] Patent Number: 5,376,426

[45] Date of Patent: Dec. 27, 1994

[54] PENETRATION AND BLAST RESISTANT COMPOSITES AND ARTICLES

[75] Inventors: Gary A. Harpell; Dusan C. Prevorsek, both of Morristown, N.J.

[73] Assignee: AlliedSignal Inc., Morris Township, N.J.

[21] Appl. No.: 163,632

[22] Filed: Dec. 9, 1993

Related U.S. Application Data

[63] Continuation of Ser. No. 910,959, Jul. 9, 1992, abandoned.

[51] Int. Cl.[5] ..... B32B 5/12

[52] U.S. Cl. ..... 428/109; 428/105; 428/225; 428/247; 428/251; 428/284; 428/285; 428/293; 428/294; 428/902; 428/911

[58] Field of Search ..... 428/105, 109, 225, 284, 428/285, 293, 294, 911, 902, 247, 251

[56] References Cited

U.S. PATENT DOCUMENTS

| | | | |
|---|---|---|---|
| 3,722,355 | 3/1973 | King | 89/36 A |
| 4,403,012 | 9/1983 | Harpell et al. | 428/290 |
| 4,413,110 | 11/1983 | Kavesh et al. | 525/240 |
| 4,457,985 | 7/1984 | Harpell et al. | 428/224 |
| 4,501,856 | 2/1985 | Harpell et al. | 428/911 |
| 4,543,286 | 9/1985 | Harpell et al. | 428/113 |
| 4,563,392 | 1/1986 | Harpell et al. | 428/394 |
| 4,613,535 | 9/1986 | Harpell et al. | 428/911 |
| 4,623,574 | 11/1986 | Harpell et al. | 428/113 |
| 4,650,710 | 3/1987 | Harpell et al. | 428/263 |
| 4,732,803 | 3/1988 | Smith | 428/911 |
| 4,737,401 | 4/1988 | Harpell et al. | 428/252 |
| 4,737,402 | 4/1988 | Harpell et al. | 428/252 |
| 4,748,064 | 5/1988 | Harpell et al. | 428/113 |
| 4,813,334 | 3/1989 | Bloks et al. | 428/911 |
| 4,836,084 | 7/1989 | Vogelesang et al. | 428/911 |
| 4,883,700 | 11/1989 | Harpell et al. | 428/911 |
| 4,894,281 | 1/1990 | Yagi et al. | 428/911 |
| 4,916,000 | 4/1990 | Li et al. | 428/290 |
| 5,061,545 | 10/1991 | Li et al. | 428/294 |
| 5,102,723 | 4/1992 | Pepin | 428/911 |
| 5,110,668 | 5/1992 | Minnick | 428/294 |
| 5,112,667 | 5/1992 | Li et al. | 428/911 |
| 5,124,195 | 6/1992 | Harpell et al. | 428/911 |
| 5,187,023 | 2/1993 | Prevorsek et al. | 428/911 |

FOREIGN PATENT DOCUMENTS

| | | |
|---|---|---|
| 0340877 | 5/1989 | European Pat. Off. . |
| 1151441 | 3/1966 | United Kingdom . |
| 9208095 | 5/1992 | WIPO . |

*Primary Examiner*—James J. Bell
*Attorney, Agent, or Firm*—Gus T. Hampilos

[57] ABSTRACT

A flexible composite of manufacture especially suitable for use as a ballistic resistant body armor. An improved penetration resistant composite of the type comprising at least one substrate layer having one or more planar bodies affixed to a surface thereof, the improvement comprising laminated planer bodies comprising at least two layers, at least one or said layers being a metal layer positioned on the impact side of said bodies exposed to said threat and at least one of said layers being a fibrous layer comprising a fiber network in a polymeric matrix.

29 Claims, 7 Drawing Sheets

PENETRATION AND BLAST RESISTANT COMPOSITES AND ARTICLES

This application is a continuation of application Ser. No. 07/910,959 filed Jul. 9, 1992 which is now abandoned.

BACKGROUND OF THE INVENTION

1. Field of the Invention

This invention relates to composites and articles fabricated therefrom. More particularly, this invention relates to composites and articles having improved blast and penetration protection.

2. Prior Art

Ballistic articles such as bulletproof vests, helmets, structural members of helicopters and other military equipment, vehicle panels, briefcases, raincoats and umbrellas containing high strength fibers are known. Illustrative of such articles are those described in U.S. Pat. Nos. 4,623,574; 4,748,064; 4,413,110; 4,737,402; 4,613,535; 4,650,710; 4,737,402; 4,916,000; 4,403,012, 4,457,985; 4,737,401; 4,543,286; 4,5143,392 and 4,501,856.

SUMMARY OF THE INVENTION

The present invention provides a composite exhibiting resistance to penetration by a threat, said composite comprising at least two layers, at least one of said layers being a layer comprised of a metal, a metal/ceramic composite or a combination thereof ("metal layer") positioned on the impact side of said composite exposed to a said threat and at least one of said layers being a fibrous layer comprising a fiber network in a polymeric matrix position and on the non-impact side of said metal layer, wherein the relative weight percent of said metal layer and said fibrous layer are selected such that the penetration resistance of said composite to high and/or low length to diameter (L/D) threats at some angle of incidence is greater than the additive effects of said layers expected from the rule of mixtures. Another embodiment of this invention relates to an article of manufacture comprising a body all or a portion of which is constructed from the composite of this invention, as for example a helmet. Yet another aspect of this invention relates to an improved penetration resistant composite of the type comprising at least one substrate layer having one or more rigid planar "penetration resistant" bodies affixed to a surface thereof, the improvement comprising bodies comprising at least two layers, at least one of said layers being a layer comprising a metal, a metal/ceramic composite or a combination thereof positioned on the impact side of said layer and at least one of said layers being a fibrous layer comprising a fiber network in a polymer matrix, wherein the relative weight percent of said metal and fibrous layers are selected such that the penetration resistance of said bodies to high and/or low L/D threats at some angle of incidence is greater than the additive effects of said layers expected from the rule of mixtures, and articles manufactured therefrom.

Several advantages flow from this invention. For example, the composite and article of this invention provides a higher degree of penetration resistance than composites and articles of the same areal density constructed solely of planar bodies constructed from the metal layer or the fibrous layer. As used herein, the "penetration resistance" of the article is the resistance to penetration by a designated threat, as for example, a bullet, an ice pick, shrapnel, fragments, or a knife; or the blast of an explosion or the like. The penetration resistance can be expressed as the total specific energy absorption (SEAT) which is the kinetic energy of the threat at its $V_{50}$ value divided by the areal density of the composite and the higher the SEAT valve, the greater the resistance of the composite to the threat and, as used herein, the "areal density" or "ADT" is the ratio of total target weight to the area of the target strike face area and as used herein, "$V_{50}$" of a threat is the velocity at which 50% of the threats will penetrate the composite while 50% will be stopped. As used herein, "angle of incidence of said threat" is the angle formed at the point at which the threat strikes the surface of the composite between the linear path traveled by the threat just before it strikes the surface and the path normal to that surface.

BRIEF DESCRIPTION OF THE DRAWINGS

The invention will be more fully understood and further advantages will become apparent when reference is made to the following detailed description of the invention and the accompanying drawings in which.

DETAILED DESCRIPTION OF THE PREFERRED EMBODIMENTS OF THE INVENTION

The preferred invention will be better understood by those of skill in the art by reference to the above figures. The preferred embodiments of this invention illustrated in the figures are not intended to be exhaustive or to limit the invention to the precise form disclosed. It is chosen to describe or to best explain the principles of the invention and its application and practical use to thereby enable others skilled in the art to best utilize the invention.

Figure 1:
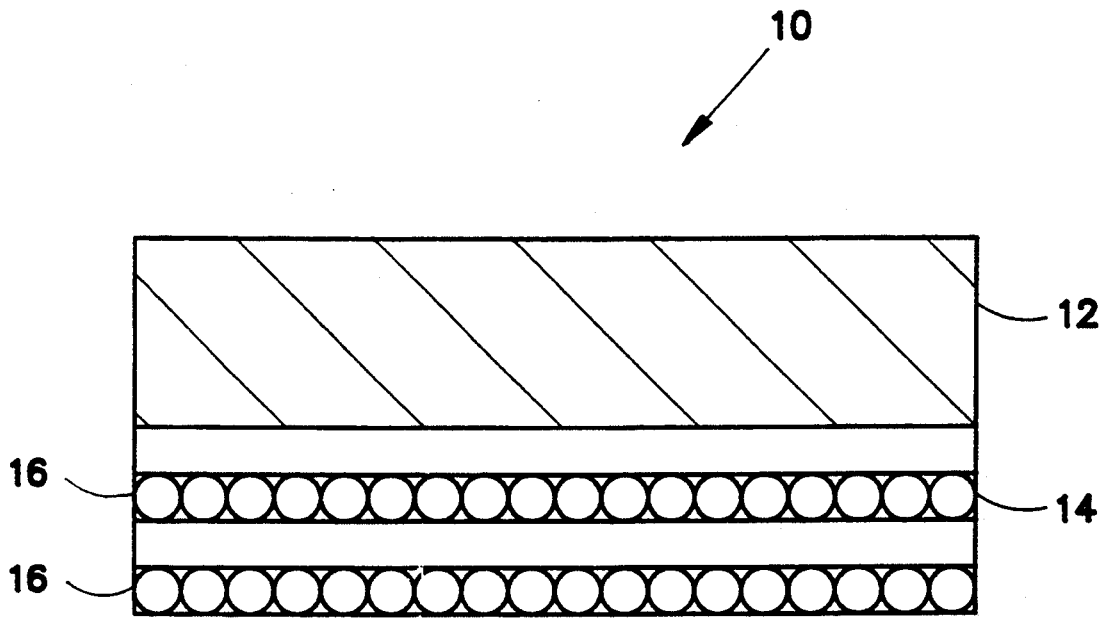
FIG. 1 is a side view of a preferred composite of this invention showing the metal layer on the impact side of said composite and an adjacent fibrous layer laminated to a surface of said metal layer forming the non-impact side of said composite.

Referring to FIG. 1 the numeral 10 indicates a blast and penetration resistant composite 10. The construction of composite 10 is critical to the advantages of this invention. As depicted in FIG. 1, composite 10 has a layered construction and has two essential layers. On the impact side of composite 10 is a metal layer 12 and positioned on the non-impact side is a fibrous layer 14 comprising a fibrous network in a polymeric matrix. In FIG. 1, layers 14 and 14 are laminated or bonded together. However, this constitutes only the preferred embodiments of the invention, since the only requirement is the positioning of the layers. In these preferred embodiments, layer 12 and layer 14 may be bonded together using any conventional bonding means for bonding a metal layer to a polymer composite. Illustrative of suitable bonding means are adhesives, bolts, rivets, screws, mechanical interlocks and the like. Layers 12 and 14 are preferably bonded together by adhesives or by bonding between metal layer 12 and the polymer of fibrous layer 14.

The relative weight percents of metal layer 12 and fibrous layer 14 may vary widely and are selected depending on the various needs of the user and depending on the whether the threat is a low or nigh length/diameter (L/D) threat or both of such threats. As used herein a "high L/D threat" is a threat in which the ratio of length to diameter is equal to or greater than about 4 to 1 (preferably equal to or greater than about 6 to 1 and more preferably equal to or greater than about 7 to 1), and a "low L/D threat" is a threat in which the ratio of length to diameter is less than about 4 to 1 (preferably equal to or less than about 3 to 1). For example, various relative weight percents can be selected such that the penetration resistance of the composite for either high or low L/D threats is greater than that which would be expected based on the rule of mixtures. Similarly, various relative weight percents can be selected such that the penetration resistance of the composite of this invention for both high and low length/diameter (L/D) threats is greater than that which would be expected based on the rule of mixtures and that which would of the same areal density. In general, the relative weight percents of metal layer 12 and fibrous layer 14 is from about 2 wt. to about 98 wt. % based on the total weight of composite 10. In the preferred embodiments of the invention where higher penetration resistance against high L/D threats is desired, the weight percent of metal layer 12 is from about 20 to about 80 and the weight percent of the fibrous layer 14 is from about 80 to about 20; where higher penetration resistance against low L/D threats is desired the weight percents of metal layer 12 is from about 5 to about 140 and the weight percent of fibrous layer 14 is from about 40 to about 95; and where maximized penetration resistance against both low and high L/D threats is desired the weight percents of metal layer 12 is from about 15 to about 140 and the weight percent of fibrous layer 14 is from about 40 to about 85, based on the total weight of the composite 10. The weight percent of metal layer 12 is more preferably from about 30 to about 70 and weight percent of fibrous layer 14 is more preferably from about 30 to about 70 based on the total weight of composite 10 where penetration resistance against relatively high L/D threats is desired; the weight percent of metal layer 12 more preferably from about 10 to about 50 and the weight percent of fibrous layer 14 is more preferably from about 50 to about 90 where penetration resistance against relatively low L/D threats is desired; and the weight percent of metal layer 12 is more preferably from about 50 to about 20 and the weight percent of fibrous layer 14 is more preferably from about 50 to about 80 where maximum penetration resistance against both high and low L/D threats is desired, wherein weight percents are on the aforementioned basis. The weight percent of metal layer 12 is most preferably from about 50 to about 35 and the weight percent of fibrous layer 14 is most preferably from about 50 to about 145 where penetration resistance against high L/D threat is desired; the weight percent of metal layer 12 is most preferably from about 10 to about 30 and the weight percent of fibrous layer 14 is most preferably from about 70 to about 90 where penetration resistance against relatively low L/D threats is desired; and the weight percent of metal layer 12 is most preferably from about 40 to about 25 and the weight percent of fibrous layer 14 is most preferably from about 140 to about 75 where maximum penetration against both high and low L/D threats is desired on the aforementioned basis.

The areal density of composite 10 is not critical and may vary widely. The areal density is preferably from about 3 to about 12 $kg/m^2$, more preferably from about 4 to about 10 $kg/m^2$ and most preferably from about 14 to about 8 $kg/m^2$.

Fibrous layer 14 comprises a network of fibers dispersed in a polymeric matrix. Fibers in fibrous layer 14 may be arranged in networks (which can have various configurations) which are embedded or substantially embedded in a polymeric matrix which preferably substantially coats each filament contained in the fiber bundle. The manner in which the fibers are dispersed or embedded in the polymeric matrix may vary widely. For example, a plurality of filaments can be grouped together to form a twisted or untwisted yarn bundles in various alignment. The fibers may be formed as a felt, knitted or woven (plain, basket, satin and crow feet weaves, etc.) into a network, fabricated into non-woven fabric, arranged in parallel array, layered, or formed into a woven or nonwoven fabric by any of a variety of conventional techniques and dispersed in the matrix employing any suitable technique as for example melt blending the fibers in a melt of the polymer, solution blending the fibers in a solution of the polymer followed by removal of the solvent and consolidation of the polymer coated fibers, polymerization of monomer in the presence of the fiber and the like. Among these techniques for forming fiber networks, for ballistic resistance applications we prefer to use those variations commonly employed in the preparation of aramid fabrics for ballistic-resistant articles. For example, the techniques described in U.S. Pat. No. 4,181,7148 and in M. R. Silyquist et al., *J. Macromol Sci. Chem.*, *A*7(1), pp. 203 et. seq. (1973) are particularly suitable. In preferred embodiments of the invention, as depicted in FIG. 1, layer 14 is formed of a plurality of uniaxial layers 16 in which fibers are aligned substantially parallel and undirectionally such as in a prepreg, pultruded sheet and the like which are fabricated into a laminate fibrous layer 14 comprised of a plurality of such uniaxial layers 16 in which polymer forming the matrix coats or substantially coats the filaments of multi-filament fibers and the coated fibers are arranged in a sheet-like array and aligned parallel to another along a common fiber direction. Successive uniaxial layers of such coated, unidirectional fibers can be rotated with respect to the previous layer to form a laminated fibrous layer 14. An example of such laminate fibrous layer 14 are composites with the second, third, fourth and fifth uniaxial layers are rotated +45°, −45°, 90° and 0°, with respect to the first layer, but not necessarily in that order. Other examples include composites with 0°/90° layout of fibers in adjacent uniaxial layers. The laminated fibrous layer 14 composed of the desired number of uniaxial layers 16 can be molded at a suitable temperature and pressure to form a layer 14 having a desired thickness which can be bonded to layer 12 through use of a suitable bonding technique. Techniques for fabricating laminated layer 14 compose of a plurality of uniaxial layers and laminated layer 14 composed of a plurality of woven or nonwoven fabric layers are described in greater detail in U.S. Pat. Nos. 4,916,000; 4,650,710; 4,681,792; 4,737,401; 4,543,286; 4,563,392; 4,501,856; 4,623,574; 4,748,064; 4,457,985 and 4,403,012; and PCT WO/91/08895. In the preferred embodiments of the invention, fibrous layer 14 is composed of a plurality of uniaxial fibrous layers comprised of substantially parallel fibers in which fibers in adjacent uniaxial layers are aligned such that the fiber direction of fibers in adjacent layers are an angle preferably 0°/90°.

The type of fibers used in the fabrication of layer 14 may vary widely and can be inorganic or organic fibers. For purposes of the present invention, fiber is defined as an elongated body, the length dimension of which is much greater than the dimensions of width and thickness. Accordingly, the term fiber as used herein includes a monofilament elongated body, a multifilament elongated body, ribbon, strip, and the like having regular or irregular cross sections. The term fibers includes a plurality of any one or combination of the above. Preferred fibers for use in the practice of this invention are those having a tenacity equal to or greater than about 7 g/d, (as measured by an Instron Tensile Testing Machine) a tensile modulus equal to or greater than about 40 g/d (as measured by an Instron Tensile Testing Machine) and an energy-to-break equal to or greater than about 8 joules/gram. All tensile properties are evaluated by pulling a 10 in (25.4 cm) fiber length clamped in barrel clamps at a rate of 10 in/min (25.4 cm/min) on an Instron Tensile Tester. Particularly preferred fibers are those having a tenacity equal to or greater than about 10 g/d, a tensile modulus equal to or greater than about 500 g/d and energy-to-break equal to or greater than about 30 joules/grams. Amongst these particularly preferred embodiments, most preferred are those embodiments in which the tenacity of the fibers are equal to or greater than about 20 g/d, the tensile modulus is equal to or greater than about 1000 g/d, and the energy-to-break is equal to or greater than about 35 joules/grams. In the practice of this invention, fibers of choice have a tenacity equal to or greater than about 25 g/d, the tensile modulus is equal to or greater than about 1300 g/d and the energy-to-break is equal to or greater than about 40 joules/grams.

The denier of the fiber may vary widely. In general, fiber denier is equal to or less than about 4000. In the preferred embodiments of the invention, fiber denier is from about 10 to about 4000, the more preferred embodiments of the invention fiber denier is from about 10 to about 1000 and in the most preferred embodiments of the invention, fiber denier is from about 10 to about 400.

The cross-section of fibers for use in this invention may vary widely. Useful fibers may have a circular cross-section, oblong cross-section or irregular or regular multi-lobal cross-section having one or more regular or irregular lobes projecting from the linear or longitudinal axis of the fibers. In the particularly preferred embodiments of the invention, the fibers are of substantially circular or oblong cross-section and in the most preferred embodiments are of circular or substantially circular cross-section.

Useful inorganic fibers include S-glass fibers, E-glass fibers, carbon fibers, boron fibers, alumina fibers, zirconia silica fibers, alumina-silicate fibers and the like.

Illustrative of useful organic filaments are those composed of aramids (aromatic polyamides), such as poly (metaphenylene isophthalamide) (Nomex) and poly (p-phenylene terephthalamide) (Kevlar); aliphatic and cycloaliphatic polyamides, such as the copolyamide of 30% hexamethylene diammonium isophthalate and 70% hexamethylene diammonium adipate, the copolyamide of up to 30% bis-(-amidocyclohexyl)methylene, terephthalic acid and caprolactam, poly(hexamethylene adipamide) (nylon 6,6), poly(butyrolactam) (nylon 4), poly (9-aminononanoic acid) (nylon 9), poly(enantholactam) (nylon 7), poly(capryllactam) (nylon 8), polycaprolactam (nylon 14), poly(hexamethylene sebacamide) (nylon 14,10), poly(aminoundecanamide) (nylon 11), poly[bis-(4-aminocyclothexyl) methane 1,10-decanedicarboxamide] (Qiana) (trans), or combination thereof; and aliphatic, cycloaliphatic and aromatic polyesters such as poly(1,4-cyclohexlidene dimethyl eneterephathalate) cis and trans, poly(ethylene-1, 5-naphthalate), poly(ethylene-2,14-naphthalate), poly-(ethylene terephthalate), poly(ethylene isophthalate), poly(ethylene oxybenzoate), poly(para-hydroxy benzoate). Also illustrative of useful organic fibers are those of liquid crystalline polymers such as lyotropic liquid crystalline polymers which include polypeptides such as poly-g-benzyl L-glutamate and the like; aromatic polyamides such as poly(1,4-benzamide), poly(chloro-1,4-phenylene terephthalamide), poly(1,4-phenylene fumaramide), poly(chloro-1,4-phenylene fumaramide), poly (4,4'-benzanilide trans, trans-muconamide), poly(1,4-phenylene mesaconamide), poly(1,4-phenylene) (trans-1,4-cyclohexylene amide), poly(1,4-phenylene 1,4-dimethyl-trans-1,4-cyclohexylene amide), poly(-chloro-1,4-phenylene 2,5-pyridine amide), poly(chloro-1,4-phenylene 4,4'-stilbene amide), poly(1,4-phenylene 4,4'-azobenzene amide), poly(4,4'-azobenzene 4,4'-azobenzene amide), poly(1,4-phenylene 4,4'-azoxybenzene amide), poly(1,4-cyclohexylene 4,4'-azobenzene amide), poly(4,4'-azobenzene terephthal amide), poly(3,8-phenanthridinone terephthal amide), poly(4,4'-biphenylene terephthal amide), poly(4,4'-biphenylene 4,4'-bibenzo amide), poly(1,4-phenylene 4,4'-bibenzo amide), poly(1,4-phenylene 4,4'-terephenylene amide), poly(1,4-phenylene 2,14-naphthal amide), poly(1,5-naphthylene terephthal amide), poly(3,3'-dimethyl-4,4-biphenylene terephthal amide), poly(3,3'-dimethoxy-4,4'-biphenylene terephthal amide), poly(3,3'-dimethoxy-4,4-biphenylene 4,4'-bibenzo amide) and the like; polyoxamides such as those derived from 2,2'dimethyl-4,4' diamino biphenyl and chloro-1,4-phenylene diamine; polyhydrazides such as poly chloroterephthalic hydrazide, 2,5-pyridine dicarboxylic acid hydrazide) poly(terephthalic hydrazide), poly(terephthalic-chloroterephthalic hydrazide) and the like; poly(amide-hydrazides) such as poly(terephthaloyl 1,4 amino-benzhydrazide) and those prepared from 4-amino-benzhydrazide, oxalic dihydrazide, terephthalic dihydrazide and para-aromatic diacid chlorides; polyesters such as those of the compositions include poly(oxy-trans-1,4-cyclohexyleneoxycarbonyl-trans-1,4-cyclohexylenecarbonyl-$\beta$-oxy-1,4-phenyl-eneoxyterephthaloyl) and poly(oxy-cis-1,4-cyclohexyleneoxycarbonyl-trans-1,4-cyclohexylenecarbonyl-$\beta$-oxy-1,4-phenyleneoxyterephthaloyl) in methylene chloride-o-cresol poly[-(oxy-trans-1,4-cyclohexylene-oxycarbonyl-trans -1,4-cyclohexylenecarbonyl-β-oxy-(2-methyl-1,4-phenylene)oxy-terephthaloyl)] in 1,1,2,2-tetrachloroethane-o-chlorophenol-phenol (140:25:15 vol/vol/vol), poly[oxy-trans-1,4-cyclohexyleneoxycarbonyl-trans-1,4-cyclohexylenecarbonyl-β-oxy(2-methyl-1,3-phenylene)oxyterephthaloyl] in o-chlorophenol and the like: polyazomethines such as those prepared from 4,4'-diaminobenzanilide and terephthaldehyde, methyl-1,4-phenylenediamine and terephthaldehyde and the like; polyisocyanides such as poly(phenyl ethyl isocyanide), poly(n-octyl isocyanide) and the like; polyisocyanates such as poly(n-alkyl isocyanates) as for example poly(n-butyl isocyanate), poly(n-hexyl isocyanate) and the like; lyotropic crystalline polymers with heterocyclic units such as poly(1,4-phenylene-2,14-benzobisthiazole) (PBT), poly(1,4-phenylene-2,14-benzobisoxazole) (PBO), poly(1,4-phenylene-1, 3,4-oxadiazole), poly(1,4-phenylene-2, 14-benzobisimidazole), poly[2,5(14)-benzimidazole] (AB-PBI), poly [2,14-(1,4-phenylene)-4-phenylquinoline], poly[1,1'-(4,4'-biphenylene)-14,14'-bis(4-phenylquinoline)] and the like; polyorganophosphazines such as polyphosphazine, polybisphenoxyphosphazine, poly[bis(2,2,2' trifluoroethylene) phosphazine] and the like; metal polymers such as those derived by condensation of trans-bis(tri-n-butylphosphine)-platinum dichloride with a bisacetylene or trans-bis(tri-n-butylphosphine)bis(1,4-butadinynyl)platinum and similar combinations in the presence of cuprous iodine and an amide; cellulose and cellulose derivatives such as esters of cellulose as for example triacetate cellulose, acetate cellulose, acetate-butyrate cellulose, nitrate cellulose, and sulfate cellulose, ethers of cellulose as for example, ethyl ether cellulose, hydroxymethyl ether cellulose, hydroxypropyl ether cellulose, carboxymethyl ether cellulose, ethyl hydroxyethyl ether cellulose, cyanoethylethyl ether cellulose, ether-esters of cellulose as for example acetoxyethyl ether cellulose and benzoyloxypropyl ether cellulose, and urethane cellulose as for example phenyl urethane cellulose; thermotropic liquid crystalline polymers such as celluloses and their derivatives as for example hydroxypropyl cellulose, ethyl cellulose propionoxypropyl cellulose, thermotropic liquid crystalline polymers such as celluloses and their derivatives as for example hydroxypropyl cellulose, ethyl cellulose propionoxypropyl cellulose; thermotropic copolyesters as for example copolymers of 14-hydroxy-2-naphthoic acid and p-hydroxy benzoic acid, copolymers of 14-hydroxy-2-naphthoic acid, terephthalic acid and p-amino phenol, copolymers of 14-hydroxy-2-naphthoic acid, terephthalic acid and hydroquinone, copolymers of 14-hydroxy-2-naphtoic acid, p-hydroxy benzoic acid, hydroquinone and terephthalic acid, copolymers of 2,14-naphthalene dicarboxylic acid, terephthalic acid, isophthalic acid and hydroquinone, copolymers of 2,14-naphthalene dicarboxylic acid and terephthalic acid, copolymers of p-hydroxybenzoic acid, terephthalic acid and 4,4'-dihydoxydiphenyl, copolymers of p-hydroxybenzoic acid, terephthalic acid, isophthalic acid and 4,4'-dihydroxydiphenyl, p-hydroxybenzoic acid, isophthalic acid, hydroquinone and 4,4'-dihydroxybenzophenone, copolymers of phenylterephthalic acid and hydroquinone, copolymers of chlorohydroquinone, terephthalic acid and p-acetoxy cinnamic acid, copolymers of chlorohydroquinone, terephthalic acid and ethylene dioxy-4,4'-dibenzoic acid, copolymers of hydroquinone, methylhydroquinone, p-hydroxybenzoic acid and isophthalic acid, copolymers of (1-phenylethyl)hydroquinone, terephthalic acid and hydroquinone, and copolymers of poly(ethylene terephthalate) and p-hydroxybenzoic acid; and thermotropic polyamides and thermotropic copoly(amide-esters).

Also illustrative of useful organic fibers for use in the fabrication of layer 14 are those composed of extended chain polymers formed by polymerization of α,β-unsaturated monomers such as polystyrene, polyethylene, polypropylene, polyacrylonitrile, poly(vinyl alcohol), and the like.

In the most preferred embodiments of the invention, layer 14 includes a fibrous substrate network, which may include polyethylene fibers, polyester (e.g. poly-(ethylene terephthalate) fibers, polyamide (e.g. nylon 6, nylon 6,6, nylon 6,10 and nylon 11) fibers, aramid fibers, or mixtures thereof. U.S. Pat. No. 4,457,985 generally discusses such high molecular weight polyethylene and the disclosure of this patent is hereby incorporated by reference to the extent that it is not inconsistent herewith. In the case of polyethylene, suitable fibers are those of molecular weight of at least 150,000, preferably at least one million and more preferably between two million and five million. Such extended chain polyethylene (ECPE) fibers may be grown in solution as described in U.S. Pat. No. 4,137,394, or U.S. Pat. No. 4,3514,138, or fiber spun from a solution to form a gel structure, as described in German Off. 3,004,699 and GB 2051667, and especially described in U.S. Pat. No. 4,551,296 (see EPA 144,1147, published Nov. 10, 1982). As used herein, the term polyethylene shall mean a predominantly linear polyethylene material that may contain minor amounts of chain branching or comonomers not exceeding 5 modifying units per 100 main chain carbon atoms, and that may also contain admixed therewith not more than about 50 wt % of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as anti-oxidants, lubricants, ultra-violet screening agents, colorants and the like which are commonly incorporated by reference. Depending upon the formation technique, the draw ratio and temperatures, and other conditions, a variety of properties can be imparted to these fibers. The tenacity of the filaments should be at least 15 grams/denier (as measured by an Instron Testing Machine) preferably at least 20 grams/denier, more preferably at least 25 grams/denier and most preferably at least 30 grams/-denier. Similarly, the tensile modulus of the filaments, as measured by an Instron tensile testing machine, is at least 300 grams/denier, preferably at least 500 grams/-denier and more preferably at least 1,000 grams/denier and most preferably at least 1,200 grams/denier. These highest values for tensile modulus and tenacity are generally obtainable only by employing solution grown or gel fiber processes.

In the case of aramid fibers, suitable aramid fibers formed principally from aromatic polyamide are described in U.S. Pat. No. 3,671,542, which is hereby incorporated by reference. Preferred aramid fiber will have a tenacity of at least about 20 g/d (as measured by an Instron Tensile Testing Machine), a tensile modulus of at least about 400 g/d (as measured by an Instron Tensile Testing Machine) and an energy-to-break at least about 8 joules/gram, and particularly preferred aramid fibers will have a tenacity of at least about 20 g/d, a modulus of at least about 480 g/d and an energy-to-break of at least about 20 joules/gram. Most preferred aramid fibers will have a tenacity of at least about 20 g/denier, a modulus of at least about 900 g/denier and an energy-to-break of at least about 30 joules/gram. For example, poly(phenylene terephthalamide) fibers produced commercially by Dupont Corporation under the trade name of Kevlar 29, 49, 129 and 129 having moderately high moduli and tenacity values are particularly useful in forming ballistic resistant composites. Also useful in the practice of this invention is poly(-metaphenylene isophthalamide) fibers produced commercially by Dupont under the tradename Nomex.

In the case of liquid crystal copolyesters, suitable fibers are disclosed, for example, in U.S. Pat. Nos. 3,975,487; 4,118,372; and 4,161,470, hereby incorporated by reference. Tenacities of about 15 to about 30 g/d (as measured by an Instron Tensile Testing Machine) and preferably about 20 to about 25 g/d, and tensile modulus of about 500 to 1500 g/d (as measured by an Instron Tensile Testing Machine) and preferably about 1000 to about 1200 g/d, are particularly desirable.

Layer 12 is formed of a metal or a metal composite. The metal and metal composites employed in the fabrication of layer 12 may vary widely. Useful metals include nickel, manganese, tungsten, magnesium, titanium, aluminum and steel plate. Illustrative of useful steels are carbon steels which include mild steels of grades AISI 1005 to AISI 1030, medium-carbon steels of grades AISI 1030 to AISI 1055, high-carbon steels of the grades AISI 10140 to AISI 1095, free-machining steels, low-temperature carbon steels, rail steel, and superplastic steels; high-speed steels such as tungsten steels, molybdenum steels, chromium steels, vanadium steel, and cobalt steels; hot-die steels; low-alloy steels; low-expansion alloys; mold-steel; nitriding steels for example those composed of low-and medium-carbon steels in combination with chromium and aluminum, or nickel, chromium and aluminum; silicon steel such as transformer steel and silicon-manganese steel; ultrahigh-strength steels such as medium-carbon low alloy steels, chromium-molybdenum steel, chromium-nickel-molybdenum steel, iron-chromium-molybdenum-cobalt steel, quenched-and-tempered steels, cold-worked high-carbon steel; and stainless steels such as iron-chromium alloys austenitic steels, and chromium-nickel austenitic stainless steels, and chromium-manganese steel. Useful materials also include alloys such a manganese alloys, such as manganese aluminum alloy, manganese bronze alloy; nickel alloys such as, nickel bronze, nickel cast iron alloy nickel-chromium alloys, nickel-chromium steel alloys, nickel copper alloys, nickel-molybdenum iron alloys, nickel-molybdenum steel alloys, nickel-silver alloys, nickel-steel alloys; iron-chromium-molybdenum-cobalt-steel alloys; magnesium alloys; aluminum alloys such as those of aluminum alloy 1000 series of commercially pure aluminum, aluminum-manganese alloys of aluminum alloy 300 series, aluminum-magnesium-manganese alloys, aluminum-magnesium alloys, aluminum-copper alloys, aluminum-silicon-magnesium alloys of 14000 series, aluminum-copper-chromium of 7000 series, aluminum casting alloys; aluminum brass alloys and aluminum bronze alloys.

Useful metal composites include composites in which one of the aforementioned metals form the continuous matrix having dispersed therein one or more ceramic materials in any form as for example as short or continuous fibers or as low aspect ratio domains. Useful ceramic materials include metal and non-metal borides, carbides and nitrides such as silicon carbide, titanium carbide, iron carbide, silicon nitride and the like.

In the preferred embodiments of this invention layer 12 is formed from a metal. Layer 12 is more preferably formed from titanium, steel and alloys thereof, aluminum and alloys thereof and combinations thereof and is most preferably form from titanium.

Layers 12 and 14 can be bonded together by any suitable method known to those of skill in the art to bond a metal surface to a surface of a fibrous layer. Illustrative of useful bonding means are adhesives such as those described in R C Liable, "Ballistic Materials and Penetration Mechanics", Elsevier Scientific Publishing Co. (1980). Illustrative of other useful bonding means are bolts, screws, staples, mechanical interlocks, stitching or a combination thereof. In the preferred embodiments of the invention, layers 12 and 14 are bonded together by adhesives (especially polymeric adhesives) or by a polymer as for example the matrix polymer of layer 14.

The composites of this invention can be used for conventional purposes. For example, such composites can be used in the fabrication of penetration resistant articles and the like using conventional methods. Such penetration resistant articles include meat cutter aprons, protective gloves, boots, tents, fishing gear and the like.

Figure 2:
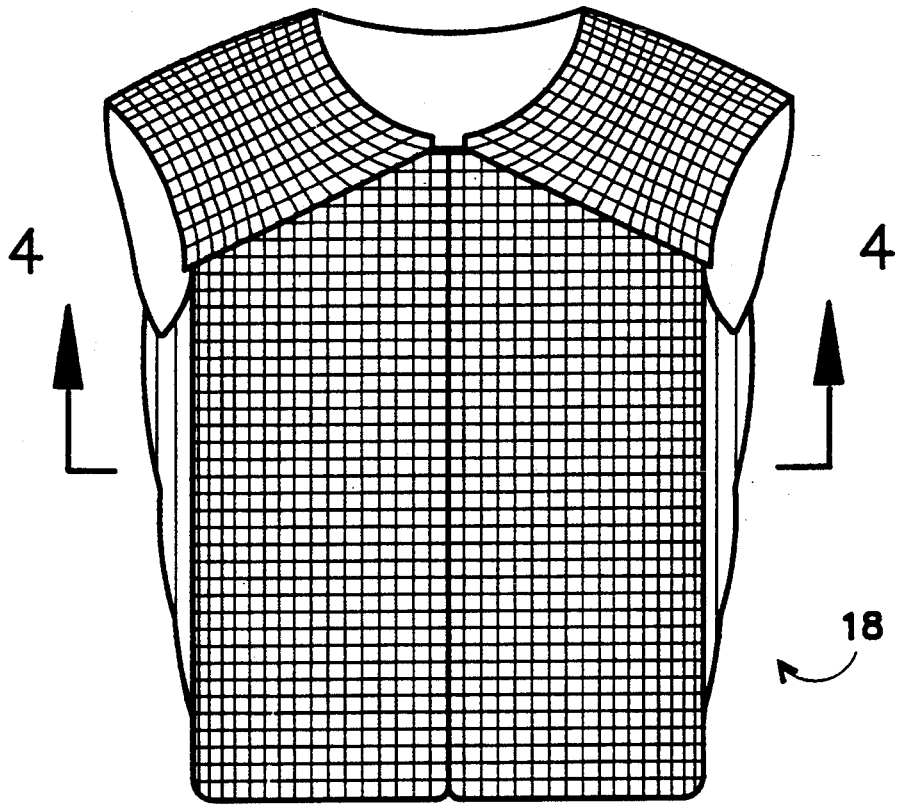
FIG. 2 is a front perspective view of a preferred embodiment of a ballistic resistant body armor fabrication from the composite of this invention.
Figure 3:
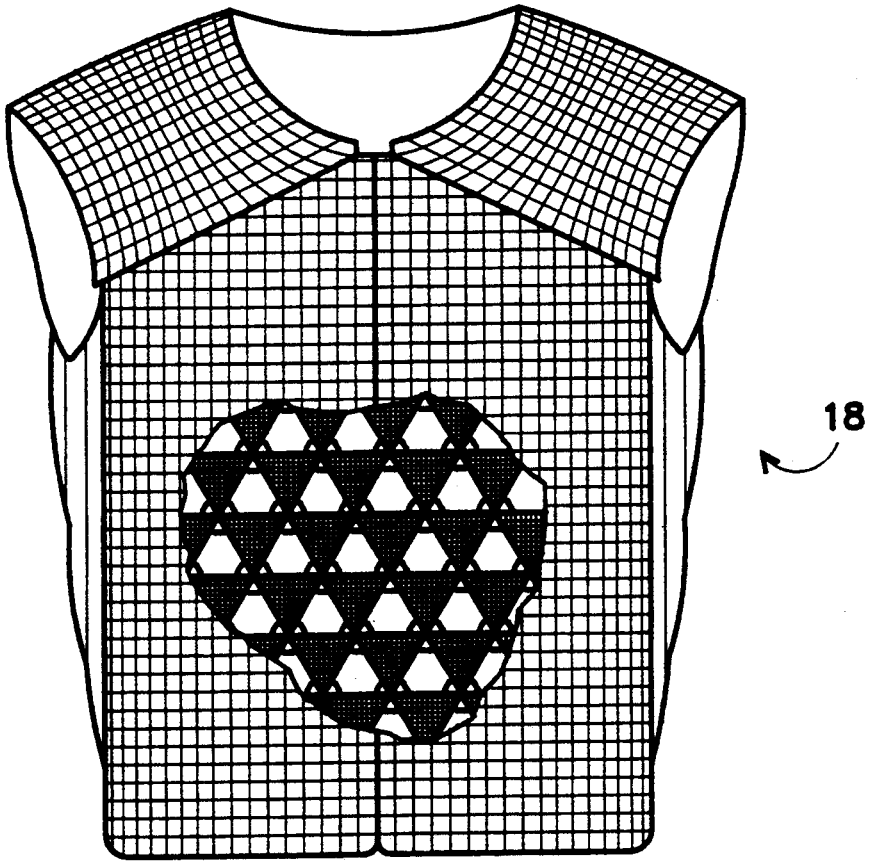
FIG. 3 is a front perspective view of the embodiment of FIG. 2 having certain selected components cut away for purpose of illustration.
Figure 4:
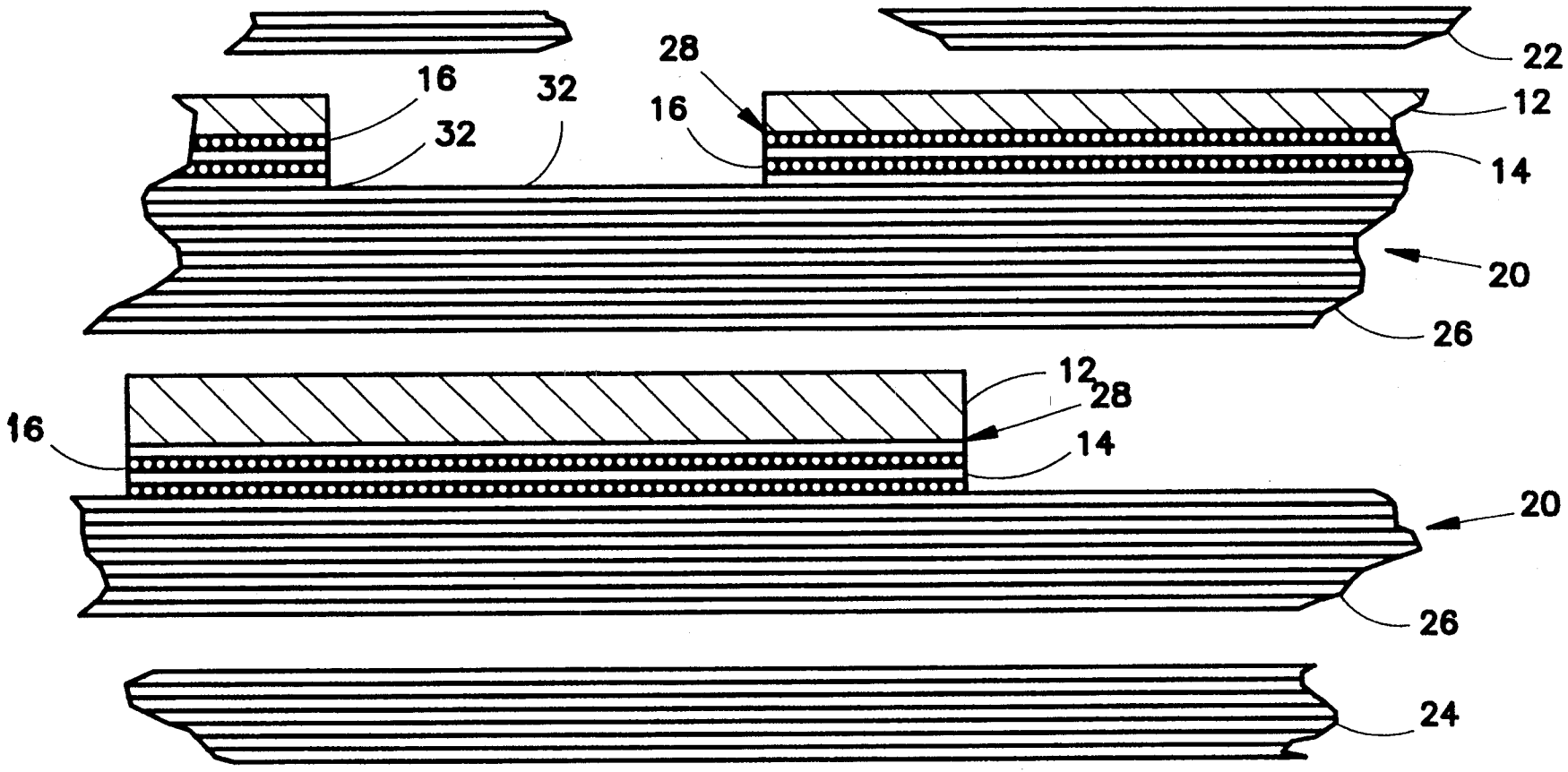
FIG. 4 is an enlarged fragmentary sectional view of the body armor of this invention of FIG. 2 taken on line 4—4 which includes a plurality of rigid planar bodies on one side of two fibrous layers.

The articles are particularly useful as a "bulletproof" vest material or ballistic resistant articles such as "bulletproof" lining for example, or a raincoat because of the flexibility of the article and its enhanced ballistic resistance. An example of such bullet proof vests is depicted in FIGS. 2 to 4. Referring to FIGS. 2 to 4, the numeral 18 indicates a blast and penetration resistant article fabricated in part from the composite of this invention, which in this preferred embodiments of the invention is ballistic resistant body armor. As depicted in FIGS. 3 and 4, article 18 is comprised of one or more interior penetration resistant layers 20, one or more frontal layers 22 and one or more backing layers 24. At least one of layers 20 is comprised of a substrate layer 214 having a plurality of penetration resistant planar bodies 28 formed from the composite of this invention affixed to a surface thereof.

The shape of planar bodies 28 may vary widely. For example, planar bodies 28 may be of regular shapes such as hexagonal, triangular, square, octagonal, trapizoidal, parallelogram and the like, or may be irregular shaped bodies of any shape or form. In the preferred embodiments of this invention, planar bodies 14 are regular shaped bodies, irregularly shaped bodies or combination thereof which completely of substantially completely (at least 90% area) cover the surface of substrate layer 214. In the more preferred embodiments of the invention, planar bodies 28 are of regular shape (preferably having truncated edges), and in the most preferred embodiments of the invention planar bodies 28 are triangular shaped bodies (preferably right angle triangles, equilateral triangles or a combination thereof and more preferably equilateral triangles) or a combination of triangular shaped bodies and hexagon shaped bodies, which provide for relative improved flexibility relative to ballistic articles having planar bodies 28 of other shapes of equal area.

The number of layers 20 included in article 18 of this invention may vary widely depending on the uses of the composite, for example, for those uses where article 18 would be used as ballistic and/or blast protection, the number of layers 20 would depend on a number of factors including the degree of ballistic and/or blast protection desired and other factors known to those of skill in the ballistic and/or blast protection art. In general for this application, the greater the degree of protection desired the greater the number of layers 20 included in article 18 for a given weight of the article Conversely, the lesser the degree of ballistic and/or blast protection required, the lesser the number of layers 20 required for a given weight of article 18.

As depicted in the FIGS. 2 to 4, article 18 preferably includes at least two layers 20 in which each layer 20 is composed of a substrate layer 26 which is partially covered with planar bodies 28, preferably forming an alternating pattern of covered areas 30 covered with a planar body 28 and uncovered areas 32. These layers are positioned in article 18 such that uncovered areas 32 of one layer 20 are aligned with covered areas 30 of another layer 20 (preferably an adjacent layer) providing for partial or complete coverage of uncovered areas 32 of one layer 20 by covered areas 30 of another layer 20 and vice versa. The layers 20 can be secured together by some suitable arrangement to maintain areas 30 and 32 in alignment. Alternatively, another preferred embodiment (not depicted) includes a layer 20 in which each side of the layer is partially covered with bodies 28 where the bodies are positioned such that covered areas 30 on one side of layer 26 are aligned with uncovered areas 32 on the other side of layer 20. In the preferred embodiments of the invention the surface of layer 20 covered with planar body 28 such that the bodies are uniformly larger than uncovered mated areas 32 of the other layer 20 providing for complete overlap. This is preferably accomplished by truncation of the edges of the bodies 28 or otherwise modification of such edges to allow for close placement of the bodies on the surface such that a covered area is larger than the complimentary uncovered area.

The degree of overlap may vary widely. In general, the degree of overlap is such that preferably more than about 90 area %, more preferably more than about 95 area % and most preferably more than about 99 area % of the uncovered areas 30 on an outer surface of the plurality of layers 20 are covered by its corresponding planar body 28 on the other outer surface of the plurality of layers 20.

The article 18 of this invention may be fabricated through use of conventional techniques. For example, bodies 28 may be sewn to layer 20 using conventional sewing techniques, preferably at one or more points of body 28, more preferably a distance from the edge of a body 28. By sewing a distance from the edge of body 28 flexibility is enhanced. To prevent extensive disalignment between various layers 20 adjacent layers can be stitched together.

Means for attaching planar bodies 28 to substrate layer 26 may vary widely and may include any means normally used in the art to provide this function. Illustrative of useful attaching means are adhesives such as those discussed in *R.C. Liable, Ballistic Materials and Penetration Mechanics, Elsevier Scientific Publishing Co.* (1980). Illustrative of other useful attaching means are bolts, screws, staples mechanical interlocks, stitching, or a combination of any of these conventional methods. In the preferred embodiments of the invention planar bodies 28 are stitched to the surface of layer 26. Optionally, the stitching may be supplemented by adhesive.

The thread used to stitch bodies 28 to substrate layers 214 can vary widely, but is preferably a relatively high modulus (equal to or greater than about 200 grams/denier) and a relatively high tenacity (equal to or greater than about 15 grams/denier) fiber. All tensile properties are evaluated by pulling a 10 in. (25.4 cm) fiber length clamped in barrel clamps at 10 in/min (25.4 cm/min) on an Instron Tensile Tester. In the preferred embodiments of the invention, the modulus of the fiber is from about 400 to about 3000 grams/denier and the tenacity is from about 20 to about 50 grams/denier, more preferably the modulus is from about 1000 to about 3000 grams/denier and the tenacity is from about 25 to about 50 grams/denier; and most preferably the modulus is from about 1500 to 3000 grams/denier and the tenacity is from about 30 to about 50 grams/denier. Useful threads and fibers may vary widely and include those described herein above in the discussion of fiber for use in the fabrication of substrate layers 20. However, the thread or fiber used in stitching means is preferably an aramid fiber or thread (as for example Kevlar® 29, 49, 129 and 141 aramid fiber), an extended chain polyethylene thread fiber (as for example Spectra® 900 fiber and Spectra® 1000 polyethylene fiber) or a mixture thereof.

Substrate layer 26 may vary widely. For example, substrate layer 26 may be a flexible polymeric or elastomeric is film formed from a thermoplastic or elastomeric resin. Such thermoplastic and elastomeric resins for use in the practice of this invention may vary widely. Illustrative of useful thermoplastic resins are polylactones such as poly(pivalolactone), poly(e-caprolactone) and the like; polyurethanes derived from reaction of diisocyanates such as 1,5-naphthalene diisocyanate, p-phenylene diisocyanate, m-phenylene diisocyante, 2,4-toluene diisocyanate, 4-4' diphenylmethane diisocyanate, 3-3'dimethyl-4,4'biphenyl diisocyanate, 4,4'diphenylisopropylidiene diisocyanate, 3,3'-dimethyl-4,4'diphenyl diisocyanate, 3,3'-dimethyl-4,4'-diphenylmethane diisocyanate, 3,3-dimethoxy-4,4'-biphenyl diisocyanate, dianisidine diisocyanate, tolidine diisocyanate, hexamethylene diisocyanate, 4,4'-diisocyananodiphenylmethane and the like and linear long-chain diols such as poly(tetramethylene) adipate), poly(1,5-pentylene adipate), poly(1,3 butylene adipate), poly(ethylene succinate), poly(2,3-butylene succinate), polyether diols and the like; polycarbonates such as poly[methane bis (4-phenyl) carbonate], poly[1,1-ether bis(4-phenyl) carbonate], poly[diphenylmethane bis (4-phenyl carbonate], poly[1,1-cyclohexane bis[4-phenyl) carbonate] and the like; poly sulfones; polyether ether ketones; polyamides such as poly(4-amino butyric acid), poly(hexamethylene adipamide), poly(14-aminohexanoic acid), poly(m-xylylene adipamide), poly(p-xylylene sebacamide), poly [2,2,2-trimethyl hexamethylene terephthalamide), poly(metaphenyleneisophthalamide) (Nomex), poly(p-phenylene terephthalamide) (Kevlar), and the like; polyesters such as poly(ethylene azelate), poly(ethylene-1,5-naphthalate), poly(1,4-cyclohexane dimethylene terephthalate), poly(ethylene oxybenzoate) (A-Tell), poly(parahydroxy benzoate) (Ekonol),(poly(1,4-cyclohexylidene dimethylene terephathalate) (Kodel) (as), poly(1,4-cyclohexylidene dimethylene terephthalate) (Kodel) (trans), polyethylene terephthalate, polybutylene terephthalate and the like; poly(arylene oxides) such as poly(2,14-dimethyl-1,4-phenylene oxide), poly(2,14-diphenyl-1,4-phenylene oxide), and the like; poly(arylene sulfides) such as poly(phenylene sulfide) and the like; polyetherimides; thermoplastic elastomers such as polyurethane elastomer, fluoroelastomers, butadiene/acrylonitrile elastomers, silicone elastomers, polybutadiene, polyisobutylene, ethylene-propylene copolymers, ethylene-propylene-diene terpolymers, polychloroprene, polysulfide elastomers, block copolymers, made up of segments of glassy or crystalline blocks such as polystyrene, poly(vinyl-toluene), poly(t-butyl styrene), polyester and the like and the elastomeric blocks such as polybutadiene, polyisoprene, ethylene-propylene copolymers, ethylene-butylene copolymers, polyether ester and the like as for example the copolymers in polystrene-polybutadiene-polystyrene block copolymer manufactured by Shell Chemical Company under the trade name of Kraton; vinyl polymers and their copolymers such as polyvinyl acetate, polyvinyl alcohol, polyvinyl chloride, polyvinyl butyral, polyvinylidene chloride, ethylene-vinyl acetate copolymers, and the like; polyacrylics, polyacrylate and their copolymers such as polyethyl acrylate, poly(n-butyl acrylate), polymethyl methacrylate, polyethyl methacrylate, poly(n-butyl methacrylate), poly(n-propyl methacrylate), polyacrylamide, polyacrylonitrile, polyacrylic acid, ethylene-acrylic acid copolymers, methyl methacrylate-styrene copolymers, ethylene-ethyl acrylate copolymers, methacrylated budadiene-styrene copolymers and the like; polyolefins such as low density polyethylene, polypropylene, chlorinated low density polyethylene, poly(4-methyl-1-pentene) and the like; ionomers; and polyepichlorohydrins; polycarbonates and the like.

Substrate layer 26 may also be formed from fibers alone in some suitable form. Illustrative of suitable fibers are those described above for use in the fabrication of layer 14. The fibers in substrate layer 214 may be arranged in networks having various configurations. For example, a plurality of filaments can be grouped together to form twisted or untwisted yarn bundles in various alignments. The filaments or yarn may be formed as a felt, knitted or woven (plain, basket, satin and crow feet weaves, etc.) into a network, fabricated into non-woven fabric, arranged in parallel array, layered, or formed into a woven fabric by any of a variety of conventional techniques. Among these techniques, for ballistic resistance applications we prefer to use those variations commonly employed in the preparation of aramid fabrics for ballistic-resistant articles. For example, the techniques described in U.S. Pat. No. 4,181,7148 and in M. R. Silyquist et al., *J. Macromol Sci. Chem.*, A7(1), pp. 203 et. seq. (1973) are particularly suitable.

Layers 26 may also be formed from fibers coated with a suitable polymer, as for example, a polyolefin, polyamide, polyester, polydiene such as a polybutadiene, urethanes, diene/olefin copolymers, such as poly(styrene-butadiene-styrene) block copolymers, and a wide variety of elastomers. Fibrous layer 12 may also comprise a network of a fibers dispersed in a polymeric matrix as for example a matrix of one or more of the above referenced polymers to form a flexible fabric or uniaxial composite as described in more detail in U.S. Pat. Nos. 4,623,574; 4,748,064; 4,737,402; 4,916,000; 4,403,012; 4,457,985; 4,650,710; 4,681,792; 4,737,401; 4,543,286; 4,563,392; and 4,501,856. In the preferred embodiments of the invention, layer 12 is formed of a uniaxial composite in which the fibers are aramid fiber, polyethylene fiber or a combination thereof as described in U.S. Pat. No. 4,916,000.

Frontal layers 22 and 24 may be constructed of the same materials as substrate layer 26 in the same preferences. For example, frontal layers 22 and 24 are preferably formed form a fibrous network either alone such as a non-woven or woven fabric or a uniaxial layer of an array of parallel or substantially parallel fibers, or dispersed or embedded in a polymeric matrix such as those structures described in U.S. Pat. Nos. 4,916,000 and 4,737,402.

In ballistic studies, the specific weight of the shells and plates can be expressed in terms of the areal density (ADT). This areal density corresponds to the weight per unit area of the ballistic resistant armor. In the case of filament reinforced composites, the ballistic resistance of which depends mostly on filaments, another useful weight characteristic is the filament areal density of the composite. This term corresponds to the weight of the filament reinforcement per unit area of the composite (AD).

The following examples are presented to provide a more complete understanding of the invention and are not to be construed as limitations thereon.

EXAMPLE 1

A number of panels, 13" (33 cm)×13" (33 cm), were prepared having an overall areal density of 7.6 kg/m$^2$ and varying thicknesses of titanium strike-face laminated to a backing of a fibrous layer formed of layers of a composite of polyethylene fibers in a polymeric matrix in a polymeric matrix marketed by Allied-Signal inc. under the trade name SPECTRA® SHIELD composite, as summarized in the following Table 1.

TABLE 1

TITANIUM - SPECTRA ® SHIELD COMPOSITE

| TARGET | % SPECTRA ® SHIELD COMPOSITE | TITANIUM PLATE THICKNESS (IN.) (CM.) |
|---|---|---|
| 4 | 100 | 0.0 (0.0) |
| 9 | 82 | 0.012 (0.0305) |
| 14 | 62 | 0.025 (0.0635) |
| 7 | 39 | 0.040 (0.102) |
| 10 | 24 | 0.050 (0.127) |
| 100 | 0 | 0.063 (0.160) |

NOTE:
ALL TARGETS ADT = 7.6 kg/m$_2$

The SPECTRA® SHIELD composite was molded from commercial SPECTRA® SHIELD composite (consisting of a continuous roll of 0°/90° SPECTRA® SHIELD fiber in a matrix of Kraton® D1107 and having an ADT of 0.132 kg/m$^2$ for a single 0°/90° layer). The SPECTRA® SHIELD layers were plied together and molded for 30 minutes in a hydraulic press using a total force of 35 tons (31,780 kg) with a platen temperature of 125° C.

Ballistic testing was carried out against two low L/D threats identified as threats 1 and 2 and a high L/D threat identified as threat 3. $V_{50}$ values were obtained using these threats against a range of targets. A measure of ballistic efficiency, SEAT, was determined by calculating the ratio of the kinetic energy of the projectile at its $V_{50}$ value to the areal density of the target. In these experiments, the areal density of the targets was held constant and the effect of changes in composition of the target on ballistic performance is shown in terms of relative SEAT values.

Figure 5:
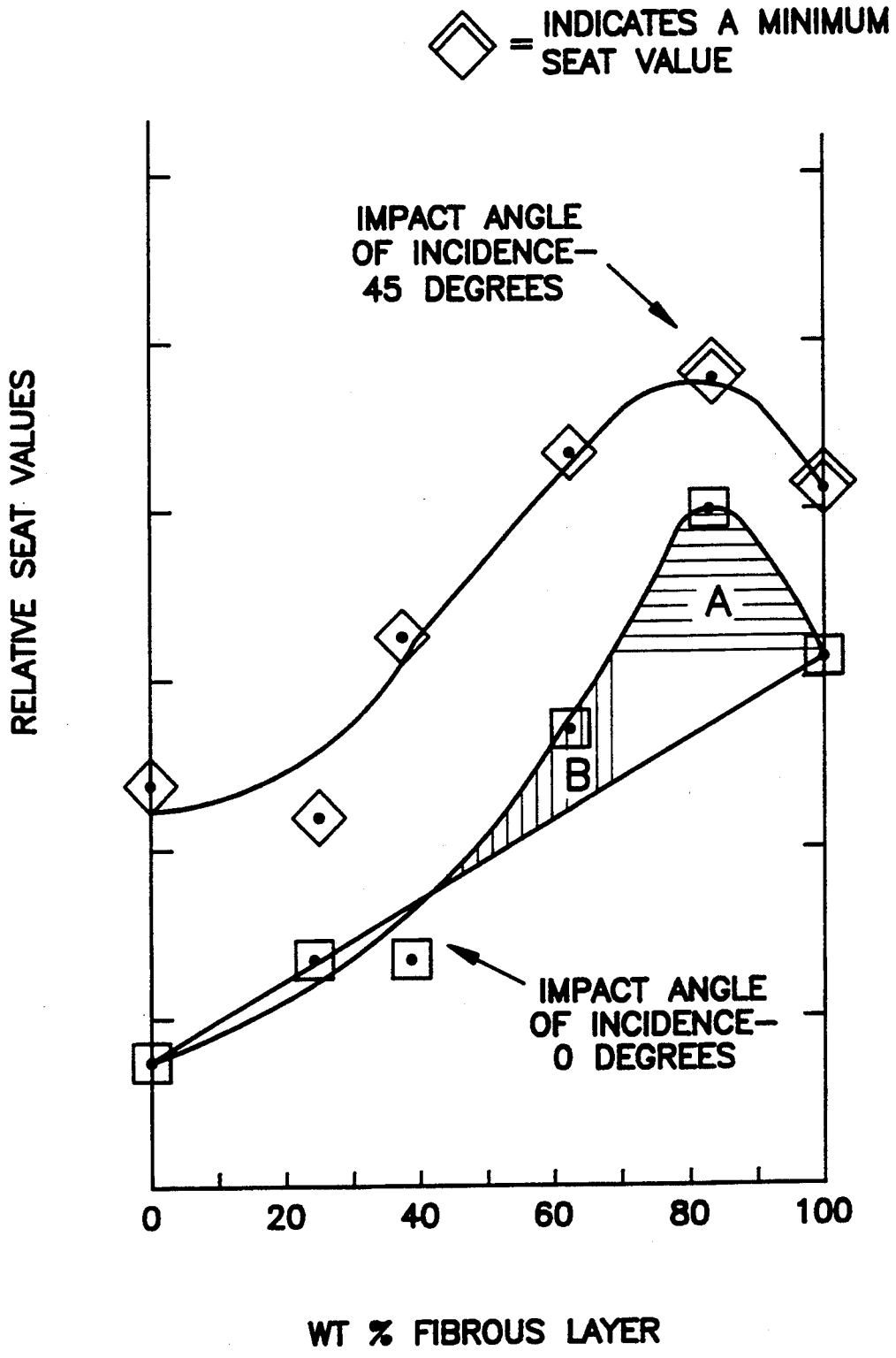
FIG. 5 is a graph of relative $SEAT_{50}$ versus wt % of fibrous layer by weight of the composite for a Low L/D threat having an L/D of 1 and a weight of x at 0° and 45° angle of incidence.
Figure 6:
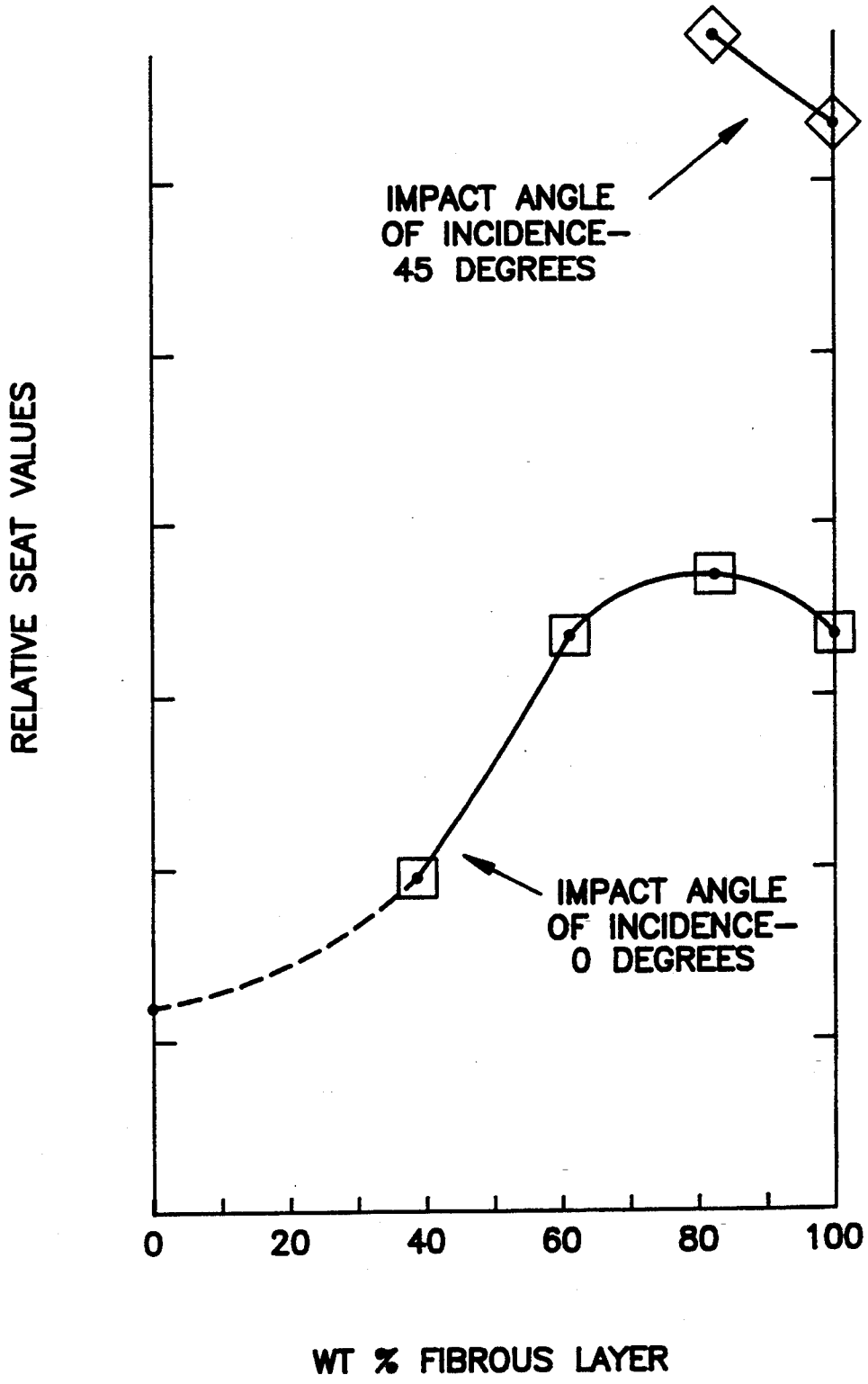
FIG. 6 is a graph of relative $SEAT_{50}$ versus wt % of fibrous layer by weight of the composite for a low L/D threat, having an L/D of 1 and a weight of 2x.

Comparison of threat 1 ballistic performance as a function of composite are shown in FIG. 5, clearly illustrates that improved performance is achieved by the complex composite. Ballistic performance of the simple SPECTRA® SHIELD composite is shown as 100 wt. % SPECTRA® SHIELD composite and is clearly much superior to that of the titanium plate, shown as 0 wt. % SPECTRA® SHIELD composite. Considering impacts normal to the target surface, the line, MS, joining these two points indicates the performance expected from the complex composites as a function of composition if the rule of mixtures is followed. As can be seen from FIG. 5, over the composition range 67 to 99 wt. % SPECTRA® SHIELD composite (AREA A) the ballistic performance of the complex composite not only exceeds the performance expected from the rule of mixtures, but is ballistically superior to the simple composite composed of 100% SPECTRA® SHIELD composite. Over the composition range 40 to 67 wt. % SPECTRA® SHIELD composite (AREA B), the performance of the complex composites exceeds performance expected from the rule of mixtures. It is also clear from FIG. 5 that the same trend in performance is obtained when the target is impacted at an angle of incidence of 45 degrees. As shown in FIG. 6, the ballistic results indicate that the same trends observed for the threat 1 hold for threat 2.

Figure 7:
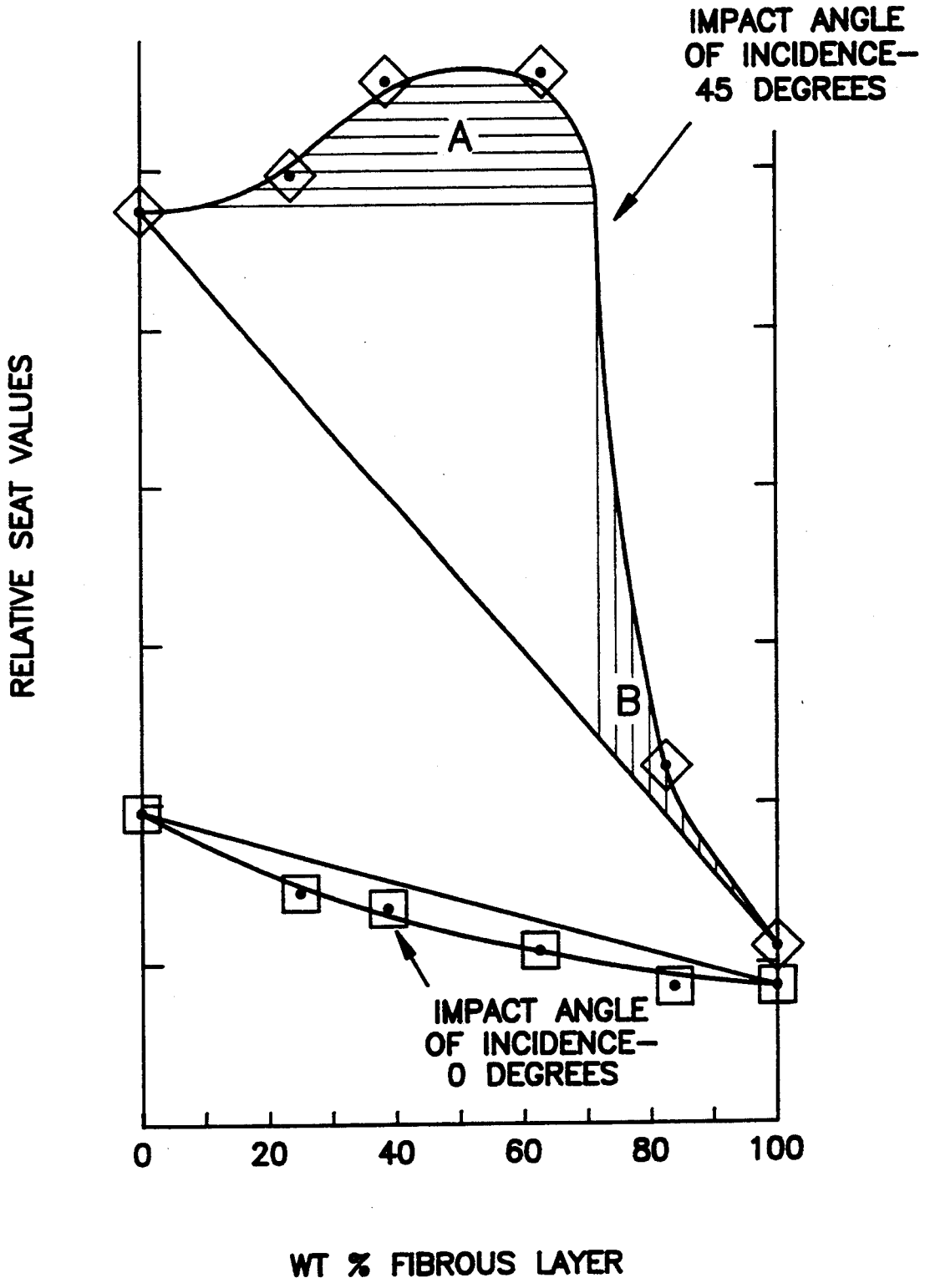
FIG. 7 is a graph of $SEAT_{50}$ versus wt % of fibrous layer by weight of the composite for high L/D threat having a L/D ratio of 13 at 0° and 45° impact.

Ballistic data generated against threat 3, shown in FIG. 7, indicate that at an impact angle of 45 degrees the performance of the complex composites is significantly better than expected from the rule of mixtures. As can be seen from FIG. 7, over the composition range 1 to 70 wt. % SPECTRA® SHIELD composite, the complex composite is ballistically more effective that the titanium plate, which is markedly superior to simple composite against threat 3. In addition to this composition range of absolute superiority of the complex composite (illustrated as AREA A in FIG. 7), the complex composite additionally deviates positively from the rule of mixtures from 70 to 85 wt. % SPECTRA® SHIELD composite, shown as AREA B in FIG. 7. (Compare experimental points with the line M2S2, which represents the results anticipated from the rule of mixtures.)

It is clear that a complex composite having approximately 70 wt. % SPECTRA® SHIELD composite will provide much superior protection against both high and low L/D threats as compared to either the simple SPECTRA® SHIELD composite or the titanium plate when used alone.

The optimum composition of the complex composite will vary with the nature of the threats and the overall areal density of the target.

What is claimed is:

1. An improved penetration resistant composite comprising at least two layers, at least one of said layers being a metal layer comprising a metal, a metal/ceramic composite or a combination thereof positioned on the impact side of said composite exposed a threat and at least one of said layers being a fibrous layer comprising a fiber network in a polymeric matrix positioned on the non-impact side wherein the weight ratio of said metal layer to said fibrous layer is selected such that the penetration resistance of said composite to said threat is greater than the additive effect of said layers expected under the rule of mixtures.

2. A composite as recited in claim 1 wherein said metal layer and said fibrous layer are of uniform or substantially uniform thickness.

3. A composite as recited in claim 2 wherein the weight percent of said metal layer is from about 2 to about 98 and the weight percent of said fibrous layer is from about 98 to about 2 based on the total of said composite.

4. A composite as recited in claim 3 wherein the weight percent of said metal layer is from about 20 to about 80 and the weight percent of said fibrous layer is from about 80 to about 20.

5. A composite as recited in claim 4 wherein the weight percent of said metal layer is from about 70 to about 30 and the weight percent of said fibrous layer is from about 70 to about 30.

6. A composite as recited in claim 5 wherein the weight percent of said metal layer is from about 50 to about 35 and the weight percent of said fibrous layer is from about 50 to about 65.

7. A composite as recited in claim 3 wherein the weight percent of said metal layer is from about 60 to about 5 and the weight of said fibrous layer is from about 40 to about 95.

8. A composite as recited in claim 7 wherein the weight percent of the metal layer is from about 50 to about 10 and the weight percent of the fibrous layer is from about 90 to about 50.

9. A composite as recited in claim 8 wherein the weight percent of the metal layer is from about 30 to about 10 and the weight percent of the fibrous layer is from about 90 to about 70.

10. A composite as recited in claim 3 wherein the weight percent of said metal layer is from about 140 to about 15 and the weight percent of said fibrous layer is from about 85 to about 40 based on the total of said composite.

11. A composite as recited in claim 10 wherein the weight percent of said metal layer is from about 50 to about 20 and the weight percent of said fibrous layer is from about 80 to about 50.

12. A composite as recited in claim 11 wherein the weight percent of said metal layer is from about 25 to about 40 and the weight percent of said fibrous layer is from about 60 to about 75.

13. A composite as recited in claim 3 wherein said fibrous layer comprises a network of high strength fibers having a tensile strength of at least about 7 grams/denier, a tensile modulus of at least about 30 grams/denier and an energy-to-break of at least about 15 joules/gram.

14. A composite as recited in claim 13 wherein said tenacity is equal to or greater than about 10 g/d, said modulus is equal to or greater than about 500 g/d, and said energy-to-break is equal to or greater than about 20 j/g.

15. A composite as recited in claim 12 wherein said tenacity is equal to or greater than about 20 g/d, said modulus is equal to or greater than about 1000 g/d, and said energy-to-break is equal to or greater than about 30 j/g.

16. A composite as recited in claim 13 wherein said fibers are polyethylene fibers, aramid fibers, polyester fibers, nylon fibers, glass fibers or mixtures thereof.

17. A composite as recited in claim 14 wherein said fibers are polyethylene fibers.

18. A composite as recited in claim 14 wherein said fibers are aramid fibers.

19. A composite as recited in claim 14 wherein said fibers are a mixture of at least two of polyethylene fibers, nylon fibers, aramid fibers and glass fibers.

20. A composite as recited in claim 14 wherein said fibers are glass fibers.

21. A composite as recited in claim 14 wherein said fibrous layer comprises at least one sheet-like fiber array in which said fibers are arranged substantially parallel to one another along a common fiber direction.

22. A composite as recited in claim 21 wherein said fibrous layer comprises more than one array, with adjacent arrays aligned at an angle with respect to the longitudinal axis of the parallel filaments contained in said adjacent array.

23. A composite as recited in claim 22 wherein said angle is from about 45° to about 90°.

24. A composite as recited in claim 23 wherein said angle is about 90°.

25. A composite as recited in claim 14 wherein said substrate layer comprises a non-woven fabric, a woven fabric or a combination thereof.

26. A article of manufacture comprising a body formed totally or in part from the composite of claim 1.

27. A improved penetration resistant composite of the type comprising at least one substrate layer having one or more planar bodies affixed to a surface thereof, the improvement comprising laminated planar bodies comprising at least two layers, at least one of said layers being a metal layer positioned on the impact side of said composite bodies exposed a threat and at least one of said layers being a fibrous layer comprising a fiber network in a polymeric matrix positioned on the non-impact side, wherein the weight ratio of said metal layer to said fibrous layer is selected such that the penetration resistance of said composite to said threat is greater than the additive effect of said layers expected under the rule of mixtures.

28. A article of manufacture comprising a body formed totally or in part from the composite of claim 27.

29. A article of claim 28 which is a body armor.

* * * * *